United States Patent [19]

Henzel

[11] Patent Number: 4,753,921

[45] Date of Patent: Jun. 28, 1988

[54] POLYMERIC SUBBING LAYER FOR SLIPPING LAYER OF DYE-DONOR ELEMENT USED IN THERMAL DYE TRANSFER

[75] Inventor: Richard P. Henzel, Webster, N.Y.

[73] Assignee: Eastman Kodak Company, Rochester, N.Y.

[21] Appl. No.: 107,826

[22] Filed: Oct. 13, 1987

[51] Int. Cl.[4] ..... B41M 5/035; B41M 5/26

[52] U.S. Cl. ..... 503/227; 8/471; 427/146; 427/256; 428/195; 428/421; 428/422; 428/447; 428/480; 428/481; 428/508

[58] Field of Search ..... 8/471; 427/146, 256; 428/195, 421, 422, 480, 447, 481, 508, 510, 532, 913, 914; 503/227

[56] References Cited

U.S. PATENT DOCUMENTS 4,559,273 12/1985 Kutsukake et al. ..... 8/471

*Primary Examiner*—Bruce H. Hess

*Attorney, Agent, or Firm*—Harold E. Cole

[57] ABSTRACT

A dye-donor element for thermal dye transfer comprising a support having on one side a dye layer and on the other side a subbing layer and a slipping layer comprising a lubricant dispersed in a binder, the subbing layer comprising a polymer having an inorganic backbone which is an oxide of a Group IVa or IVb element, such as a titanium or zirconium alkoxide, and the binder contains hydroxyl groups, such as a cellulosic binder.

20 Claims, No Drawings

POLYMERIC SUBBING LAYER FOR SLIPPING LAYER OF DYE-DONOR ELEMENT USED IN THERMAL DYE TRANSFER

This invention relates to dye-donor elements used in thermal dye transfer, and more particularly to the use of a particular subbing layer to bond the slipping layer to the support.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. A slipping layer on the back of the dye-donor element is therefore required to prevent the sticking which would otherwise occur. A subbing layer is also usually needed to promote adhesion between the support and the slipping layer. Many of the normal photographic subbing materials for polyester supports have been found to be unsuitable for dye-donor elements which have other requirements.

U.S. Pat. No. 4,559,273 relates to a dye-donor element having a slipping layer on the back side thereof, and wherein a primer layer is disclosed to be useful to improve the bonding strength. In column 4, it is stated that known primers can be used, and that the adhesion is improved when the primer layer is formed from acrylic resin, polyester resin and polyol/diisocyanate. No particular materials are disclosed, however.

In U.S. application Ser. No. 37,299 of my co-workers, Harrison, Kan and Vanier, certain copolyesters are described as subbing layers for the slipping layer. A problem has developed with use of those materials in the amount of force required to pass the dye-donor and receiver through the nip formed by the thermal print head and the roller. A large amount of force could result in chatter marks or other defects in the final print. It would be desirable to find a subbing layer which would lower the force required for passage of the dye-donor element through the thermal print head and roller.

These and other objects are achieved by this invention which relates to a dye-donor element for thermal dye transfer comprising a support having on one side thereof a dye layer and on the other side thereof, in order, a subbing layer and a slipping layer comprising a lubricant dispersed in a binder, and wherein the subbing layer comprises a polymer having an inorganic backbone which is an oxide of a Group IVa or IVb element and the binder contains hydroxyl groups.

In a preferred embodiment of the invention, the Group IVa or Group IVb element is titanium, zirconium or silicon. In another preferred embodiment, the polymer is formed from an organic titanate or zirconate, such as tetrakis(2-ethylhexyl)titanate, bis(ethyl-3-oxobutanolato-$O^1$,$O^3$)bis(2-propanolato)-titanium, isopropyl triisostearoyl titanate or neopentyl(diallyloxy) tri(N-ethylenediamino)ethyl zirconate (Kenrich Petro Chemical, Bayonne, N.J.); or is formed from a titanium or zirconium alkoxide, such as titanium tetra-isopropoxide, titanium tetra-n-butoxide (commercially available as Tyzor TBT ® from duPont) or zirconium n-propoxide.

The titanium or zirconium alkoxides are believed to undergo hydrolysis at varying rates to form the inorganic polymer. They thus act as surface water scavengers.

The subbing layer may be present in any concentration which is effective for the intended purpose. In general, good results have been obtained at concentrations of from about 0.005 to 1.0 g/m$^2$ of coated element.

Any lubricant can be employed in the slipping layer of the invention as long as it has the desired effect. There can be employed, for example, a surface active agent, a liquid lubricant, a solid lubricant or mixtures thereof, dispersed in a polymeric binder. Such lubricants include oils or semi-crystalline organic solids that melt below 100° C. such as poly(vinyl stearate), beeswax, perfluorinated alkyl ester polyethers, poly(caprolactone), carbowax or poly(ethylene glycols).

In a preferred embodiment of the invention, the lubricant comprises poly(tetrafluoroethylene) particles such as duPont DLX-6000 Teflon ® micropowder or Emralon 329 ® poly(tetrafluoroethylene) particles of irregular shape in a cellulose nitrate binder (Acheson Colloid).

In another preferred embodiment of the invention, the lubricant comprises a linear or branched aminoalkyl-terminated poly(dialkyl, diaryl or alkylaryl siloxane). Examples of such silanes are found in application Ser. No. 062,796 of my co-workers, Vanier and Evans, and include, for example, an aminopropyldimethyl-terminated polydimethylsiloxane such as one having the formula:

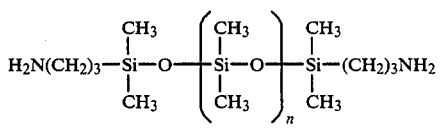

wherein n is from about 10 to about 2000. This material is supplied commercially from Petrarch Systems, Inc. Bartram Rd. Bristol, Pa. 19007 as PS513 ®.

Another siloxane polymer which can be employed is a T-structure polydimethylsiloxane with an aminoalkyl functionality at the branchpoint, such as one having the formula

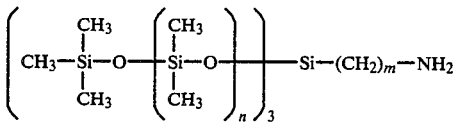

wherein m is from about 1 to about 10 and n is from about 10 to about 1000. This material is supplied commercially from Petrarch Systems, Inc. as PS054®. Other materials are found in the U.S. Ser. No. 062,796 referred to above.

Any binder can be employed to disperse the lubricant as long as it contains hydroxyl groups to attach to the subbing layer, such as polyvinylacetals (such as Butvar 76®, Monsanto), polyvinylalcohol, hydroxyalkylacrylates such as 2-hydroxyethyl acrylate, poly(ethylene-co-vinyl alcohols), poly(styrene-co-allyl alcohol), and phenoxy resins such as those prepared from epichlorhydrin and bisphenol A.

In a preferred embodiment, cellulosic binders are employed such as cellulose nitrate, cellulose acetate propionate, cellulose acetate hydrogen phthalate, cellulose acetate, cellulose acetate butyrate, cellulose triacetate, etc.

The amount of lubricant to be used in the slipping layer depends largely on the type of lubricant, but is generally in the range of from about 0.001 to about 2 g/m$^2$, or 0.1 to 50 weight %, preferable 0.5 to 40, of the binder employed.

The amount of binder used in the slipping layer described above is not critical. In general the binder may be present in an amount of from about 0.1 to about 2 g/m$^2$, representing from about 1 to about 80% of the total layer coverage.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® products of Nippan Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

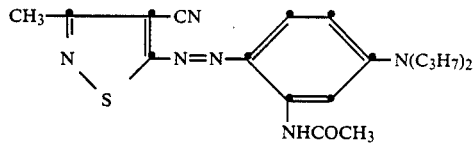

(magenta)

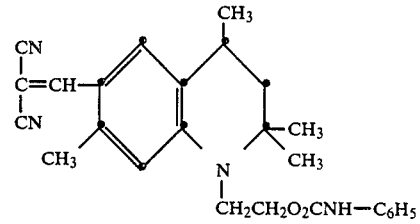

(yellow)

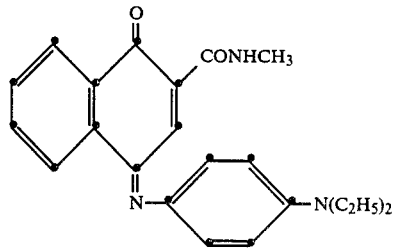

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A cyan dye-donor element was prepared by coating on a subbed 6 μm poly(ethylene terephthalate) support a dye layer containing the following cyan dye (0.28 g/m$^2$), duPont DLX-6000 Teflon® micropowder (0.016 g/m$^2$) in a cellulose acetate propionate (45% propionyl, 2.5% acetyl) binder (0.44 g/m$^2$) coated from a toluene, methanol and cyclopentanone solvent mixture.

Cyan dye:

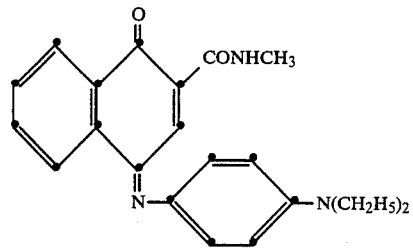

On the back side of the dye-donor was coated a subbing layer of 0.16 g/m$^2$ of duPont Tyzor TBT® titanium tetra-n-butoxide or zirconium n-propoxide (Alpha Products, Inc.) coated from 1-butanol or 1-propanol, respectively. On top of this was coated a slipping layer of Emralon 329® poly(tetrafluoroethylene) particles of irregular shape ranging from 1 to 5 μm diameter in a cellulose nitrate binder (Acheson Colloid) in the amount stated in Table 1 coated from a n-propyl acetate and toluene solvent mixture containing small amounts of 2-propanol and 1-butanol.

A control dye-donor element was prepared by coating the same slipping layer but without the subbing layer.

The back side of each dye-donor element (the side containing the slipping layer) was subjected to a tape adhesion test. The slipping layer was first carefully scored in an "X" pattern. A small area (approximately ¾ inch×2 inches) of Scotch® Magic Transparent Tape (3M Corp.) was firmly pressed by hand over the scored area of the dye-donor, leaving enough area free to serve as a handle for pulling the tape. Upon manually pulling the tape, ideally none of the backing layer would be removed. Backing layer removal indicated a weak bond between the poly(ethyleneterephthalate) support and the coated backing layer. The following categories were established:

E—excellent (no layer removal)

G—good (a small amount of layer removal)

F—fair (partial layer removal)

P—unacceptable (substantial or total layer removal)

The following results were obtained:

TABLE 1

| Subbing Layer | Slipping Layer (g/m$^2$) | Tape Test |
|---|---|---|
| None-Control | Emralon 329 ® (0.27) | P |
| None-Control | Emralon 329 ® (0.54) | P |
| Tyzor TBT ® | Emralon 329 ® (0.27) | E |
| Tyzor TBT ® | Emralon 329 ® (0.54) | E |
| Zirconium n-propoxide | Emralon 329 ® (0.54) | E |

The subbing layer of the invention thus greatly improves the adhesion of the slipping layer to the support.

The dye-donor element of the invention containing the subbing layer passed through the thermal head with ease and produced images free from gross physical defects.

EXAMPLE 2

(A) Dye-donors of the invention were prepared as in Example 1, except that the back side was coated with a subbing layer of duPont Tyzor TBT ® titanium tetra-n-butoxide at the concentration listed in Table 2 coated from 1-butanol. On top of this was coated a slipping layer of Emralon 329 ® poly(tetrafluoroethylene) particles as in Example 1.

(B) Another dye-donor element of the invention was prepared similar to (A) except that the slipping layer was PS-513 ® an aminopropyldimethyl-terminated polydimethylsiloxane (Petrarch Systems Inc.) (0.016 g/m$^2$) neutralized with 0.0004 g/m$^2$ p-toluene sulfonic acid in a binder of cellulose acetate propionate (2.5% acetyl, 45% propionyl) (0.54 g/m$^2$) coated from a toluene and 3-pentanone solvent mixture.

The tape adhesion test was performed as in Example 1 with the following results:

TABLE 2

| Subbing Layer (g/m$^2$) | Slipping Layer | Tape Test |
|---|---|---|
| None-Control | Emralon 329 ® | P |
| Tyzor TBT ® (0.005) | Emralon 329 ® | G |
| Tyzor TBT ® (0.01) | Emralon 329 ® | G |
| Tyzor TBT ® (0.02) | Emralon 329 ® | E |
| Tyzor TBT ® (0.05) | Emralon 329 ® | E |
| Tyzor TBT ® (0.16) | Emralon 329 ® | E |
| Tyzor TBT ® (0.32) | Emralon 329 ® | E |
| Tyzor TBT ® (0.54) | Emralon 329 ® | G |
| Tyzor TBT ® (1.1) | Emralon 329 ® | G |
| None-Control | Amino-siloxane | P |
| Tyzor TBT ® (0.005) | Amino-siloxane | G |
| Tyzor TBT ® (0.01) | Amino-siloxane | G |
| Tyzor TBT ® (0.02) | Amino-siloxane | E |
| Tyzor TBT ® (0.05) | Amino-siloxane | E |
| Tyzor TBT ® (0.16) | Amino-siloxane | E |
| Tyzor TBT ® (0.32) | Amino-siloxane | E |
| Tyzor TBT ® (0.54) | Amino-siloxane | G |
| Tyzor TBT ® (1.1) | Amino-siloxane | G |

The above data show that the subbing layer of the invention greatly improves the adhesion of the slipping layer to the support for two different types of slipping layers having two different binders. The dye-donor element of the invention containing the subbing layer also passed through the thermal head with ease and produced images free from gross physical defects.

EXAMPLE 3

A control dye-donor element was prepared as in Example 1 except that on the back side of the dye-donor was coated a subbing layer of 0.16 g/m$^2$ of poly(acrylonitrile-co-vinylidene chloride-co-acrylic acid) (AN-VC-AA) (14:79:7 wt. ratio) from a toluene and 3-pentanone solvent mixture. This material is used as a subbing layer in application Ser. No. 916,138 of my co-worker Ducharme for the dye-binder layer. On top of this was coated a slipping layer of Emralon 329 ® poly(tetrafluoroethylene) particles of irregular shape ranging from 1 to 5 μm diameter in a cellulose nitrate binder (Acheson Colloid) (0.54 g/m$^2$) coated from a n-propyl acetate and toluene solvent mixture containing small amounts of 2-propanol and 1-butanol.

Another control dye-donor element was prepared as in Example 1 except that on the back side of the dye-donor was coated a subbing layer of 0.54 g/m$^2$ of Bostik 7650 ® (Bostik Chemical Group, Emhart Corp.) a linear saturated copolyester (described as a polyethylene isophthalate modified with 40 mole % terephthalic acid, 23% mole % butylene glycol, and 19 mole % hexylene glycol) coated from a toluene and 3-pentanone solvent mixture. This subbing layer is described and claimed in application Ser. No. 037,299 described above. On top of this was coated a slipping layer of Emralon 329 ® poly(tetrafluoroethylene) particles as above.

A dye-donor element according to the invention was prepared as in Example 1 similar to the control elements above except that it contained duPont Tyzor TBT ® titanium tetra-n-butoxide (0.16 g/m$^2$) or titanium n-propoxide (Alpha Products, Inc.) (0.16 g/m$^2$) coated from 1-butanol or 1-propanol, respectively.

The back-side of each element was subjected to the tape test described in Example 1 and the adhesion was found to be excellent.

The dye-donor elements were then evaluated for the force required for a stepper motor driven pulling device to pull the dye-donor and a receiver element between a print head and a roller. The force was measured using a Himmelstein Corp. 10010 Strain Gauge (10 lb. range) and 6-205 Conditioning Module. The force required at Step 8 (maximum density) was recorded as being the most responsive for evaluation purposes. The following results were obtained:

TABLE 3

| Subbing Layer | Relative Force (lbs) |
|---|---|
| AN-VC-AA | 3.9 |
| Polyester | 3.4 |
| Tyzor TBT ® | 1.7 |
| Zirconium n-propoxide | 1.6 |

The above results indicate that use of the subbing layer according to the invention required much less force for passage through the thermal print head as compared to other subbing layers, thus reducing the likelihood of obtaining chatter marks and other defects in the final print.

EXAMPLE 4

Different Binders

Dye-donor elements were prepared as in Example 1 except that the slipping layer was PS-513 ® an aminopropyldimethyl-terminated polydimethylsiloxane (Petrarch Systems Inc.) (0.016 g/m$^2$) neutralized with 0.0004 g/m$^2$ p-toluene sulfonic acid in the following binders:

- Poly(methyl methacrylate) (0.54 g/m$^2$) coated from a 2-butanone and cyclopentanone solvent mixture;
- Poly(styrene-co-acrylonitrile) (70:30 wt. ratio) (0.54 g/m$^2$) coated from a toluene and 3-pentanone solvent mixture;
- Poly(vinyl alcohol-co-butyral) (Butvar ® 76, Monsanto) (0.54 g/m$^2$) coated from a toluene and 3-pentanone solvent mixture;
- Cellulose acetate propionate (2.5% acetyl, 45% propionyl) (0.54 g/m$^2$) coated from a toluene and 3-pentanone solvent mixture; and
- Cellulose nitrate (low ½ sec. viscosity, low free hydroxyl) (Hercules Chemical RS) (0.54 g/m$^2$) coated from a toluene and 3-pentanone solvent mixture.

Control dye-donor elements were prepared by coating the same slipping layer but without the subbing layer.

The tape adhesion test was run as in Example 1 with the following results:

TABLE 4

| Subbing Layer | Slipping Layer Binder | Tape Test |
|---|---|---|
| None-Control | Methacrylate | P |
| Tyzor TBT ®-Control | Methacrylate | P |
| None-Control | Styrene-acrylonitrile | P |
| Tyzor TBT ® Control | Styrene-acrylonitrile | P |
| None-Control | Polyvinyl butyral | P |
| Tyzor TBT ® | Polyvinyl butyral | E |
| None-Control | Cell. acetate propion. | P |
| Tyzor TBT ® | Cell. acetate propion. | E |
| Zirconium n-propoxide | Cell. acetate propion. | E |
| None-Control | cellulose nitrate | P |
| Tyzor TBT ® | cellulose nitrate | E |

The above results indicate that a titanium or zirconium alkoxide subbing layer according to the invention provides superior adhesion to the support for slipping layers containing hydroxyl groups.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side thereof, in order, a subbing layer and a slipping layer, the slipping layer comprising a lubricant dispersed in a binder, the improvement wherein said subbing layer comprises a polymer having an inorganic backbone which is an oxide of a Group IVa or IVb element and said binder contains hydroxyl groups.

2. The element of claim 1 wherein said Group IVa or IVb element is titanium, zirconium or silicon.

3. The element of claim 1 wherein said subbing layer polymer is formed from an organic titanate or zirconate.

4. The element of claim 1 wherein said subbing layer polymer is formed from a titanium or zirconium alkoxide.

5. The element of claim 1 wherein said subbing layer polymer is formed from titanium tetra-n-butoxide.

6. The element of claim 1 wherein said subbing layer polymer is formed from a zirconium n-propoxide.

7. The element of claim 1 wherein said binder is a cellulosic binder.

8. The element of claim 7 wherein said cellulosic binder is cellulose nitrate or cellulose acetate propionate.

9. The element of claim 1 wherein said lubricant comprises poly(tetrafluoroethylene) particles or a linear or branched aminoalkyl-terminated poly(dialkyl, diaryl or alkylaryl siloxane).

10. The element of claim 1 wherein said lubricant comprises an aminopropyldimethyl-terminated polydimethylsiloxane.

11. The element of claim 1 wherein said support is poly(ethylene terephthalate).

12. In a process of forming a dye transfer image comprising (a) imagewise-heating a dye-donor element comprising a support having on one side thereof a dye layer and on the other side thereof, in order, a subbing layer and a slipping layer, the slipping layer comprising a lubricant dispersed in a binder, and (b) transferring a dye image to a dye-receiving element to form said dye transfer image, the improvement wherein said subbing layer comprises a polymer having an inorganic backbone which is an oxide of a Group IVa or IVb element and said binder contains hydroxyl groups.

13. The process of claim 12 wherein said subbing layer polymer is formed from an organic titanate or zirconate.

14. The process of claim 12 wherein said subbing layer polymer is formed from a titanium or zirconium alkoxide.

15. The process of claim 12 wherein said binder is a cellulosic binder.

16. The process of claim 12 wherein said lubricant comprises poly(tetrafluoroethylene) particles or a linear or branched aminoalkyl-terminated poly(dialkyl, diaryl or alkylaryl siloxane).

17. In a thermal dye transfer assemblage comprising:

(a) a dye-donor element comprising a support having on one side thereof a dye layer and on the other side thereof, in order, a subbing layer and a slipping layer, the slipping layer comprising a lubricant dispersed in a binder, and (b) a dye-receiving element comprising a support having thereon a dye image-receiving layer, said dye-receiving element being in a superposed relationship with said dye-donor element so that said dye layer is in contact with said dye image-receiving layer, the improvement wherein said subbing layer comprises a polymer having an inorganic backbone which is an oxide of a Group IVa or IVb element and said binder contains hydroxyl groups.

18. The assemblage of claim 17 wherein said subbing layer polymer is formed from an organic titanate or zirconate.

19. The assemblage of claim 17 wherein said subbing layer polymer is formed from a titanium or zirconium alkoxide.

20. The assemblage of claim 17 wherein said lubricant comprises poly(tetrafluoroethylene) particles or a linear or branched aminoalkyl-terminated poly(dialkyl, diaryl or alkylaryl siloxane).

* * * * *